US005422610A

United States Patent [19]

Heine et al.

[11] Patent Number: 5,422,610

[45] Date of Patent: Jun. 6, 1995

[54] MULTI-FILTER DEVICE AND METHOD OF MAKING SAME

[75] Inventors: David R. Heine; Mark H. Ballance, both of Albuquerque, N. Mex.

[73] Assignee: Motorola, Inc., Schaumburg, Ill.

[21] Appl. No.: 128,959

[22] Filed: Sep. 29, 1993

[51] Int. Cl.[6] ..... H01P 1/205

[52] U.S. Cl. ..... 333/134; 333/206; 333/207; 455/82

[58] Field of Search ..... 333/202, 203, 206, 207, 333/222, 223, 235; 455/82, 134, 78, 80, 83

[56] References Cited

U.S. PATENT DOCUMENTS

| | | | |
|---|---|---|---|
| 4,806,889 | 2/1989 | Nakano et al. | 333/206 X |
| 4,954,769 | 9/1990 | Green et al. | 333/206 |
| 5,109,207 | 4/1992 | Aizawa et al. | 333/222 |
| 5,130,682 | 7/1992 | Agahi-Kesheh | 333/206 X |
| 5,250,916 | 10/1993 | Zakman | 333/134 X |

FOREIGN PATENT DOCUMENTS

| | | | |
|---|---|---|---|
| 0508812 | 10/1992 | European Pat. Off. | 333/202 |
| 0073801 | 4/1987 | Japan | 333/202 |
| 00846021 | 4/1987 | Japan | 333/202 |
| 0104201 | 5/1987 | Japan | 333/202 |
| 0235801 | 10/1987 | Japan | 333/202 |
| 0090201 | 4/1988 | Japan | 333/202 |

*Primary Examiner*—Seungsook Ham
*Attorney, Agent, or Firm*—Steven G. Parmelee

[57] ABSTRACT

A multi-filter device comprising a ceramic block (10) having at least two filters A and B. Both filters A and B include a notch (11 and 13, respectively) formed on one side of the ceramic block (10), such that these notches are flanked by ceramic block material extensions (32). So configured, coarse tuning of the ceramic block (10) can be accomplished through use of existing double-sided lap techniques, yet constant parameter alteration for both filters will be maintained during the milling process.

18 Claims, 2 Drawing Sheets

MULTI-FILTER DEVICE AND METHOD OF MAKING SAME

FIELD OF THE INVENTION

This device relates generally to multi-filter devices, and particularly to ceramic block filters.

BACKGROUND OF THE INVENTION

Multi-filter devices are well understood in the art. For example, many two-way radios, including cellular telephones, utilize ceramic block duplex filters. Such ceramic block filters typically provide both a transmitter and receiver filter function. The passband for the transmit filter can be, for example, 824–849 MHz in a cellular telephone. The receive passband for a corresponding receiver filter can be 869–894 MHz.

Typically, during the manufacturing process, such ceramic filters must be milled during a coarse tuning process. Many times, this milling process is accomplished through use of a double-sided lap mechanism. When using this process, material is removed from two opposing sides of the ceramic filter simultaneously. This milling process compensates for shifts in the dielectric material itself, and effectively moves the passbands of the filter.

Unfortunately, to date, double-sided lapping techniques will cause both filter passbands in a multi-filter device to be simultaneously changed, but the degree of change in each filter will be different. This can render the coarse tuning process more difficult, and can considerably complicate the fine tuning process that follows.

Accordingly, a need exists for a way to better allow double-sided lapping processes to be utilized when coarse tuning a multi-filter ceramic block.

DESCRIPTION OF A PREFERRED EMBODIMENT

Figure 1:
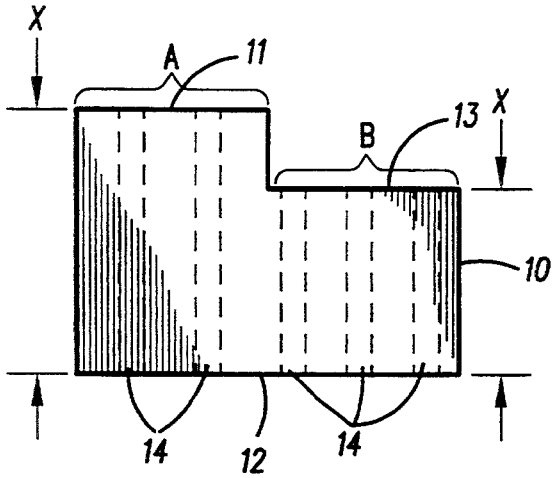
PRIOR ART FIG. 1
FIG. 1 comprises a side elevational view of a prior art multi-filter ceramic block.

Prior to describing an embodiment of the present invention, it will be helpful to the reader to first understand in more detail the relevant prior art. Referring to FIG. 1, a prior art multi-filter ceramic block (10) includes a first filter A and a second filter B. The first filter A has a first surface (11) that is offset from an opposing surface (12) by amount X. Similarly, filter B has a first surface (13) that is offset from the same opposing side (12) by amount Y, which is less than amount X. In effect, the first surface (13) of filter B comprises a notch formed in the ceramic block (10). Each filter A and B then includes a plurality of cavities (14) that extend from the opposing surface (12) to the appropriate corresponding filter surface (11 and 13, respectively).

The above described ceramic block configuration can be formed through a variety of well known and understood prior art techniques. Hence, the precise method of forming this block will not be described here.

The ceramic block, when completed, should preferably have final desired operating characteristics. In this particular example, the desired operating characteristics are the two passbands as described earlier. Depending upon the precise characteristics of the dielectric material that comprises the ceramic block, however, the ceramic block as initially formed will not yield the desired final operating characteristic. Therefore, those skilled in the art will mill material away from the ceramic block.

When using a double-sided lapping technique, material will be removed from both the opposing side (12) and the first surface (11). It should be clear from the figure that material will be removed from the bottom of the block in a way that will simultaneously effect the length of the cavities (14) for both filter A and filter B. Hence, the frequency characteristics of both filters will be simultaneously effected. The milling process on the opposing side, however, will not initially impact both filters. Rather, the filter A surface (11) will be subjected to milling prior to the filter B surface (13). As a result, when double-sided lapping, filter A will be modified at a different rate than will filter B.

Figure 2:
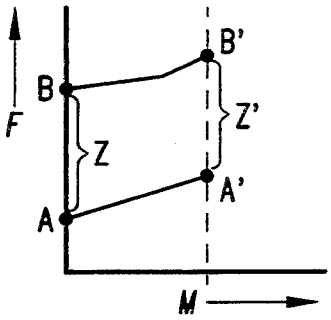
PRIOR ART FIG. 2
FIG. 2 comprises a graph depicting frequency characteristics of a prior art multi-filter ceramic block during a double-sided lap procedure.

This dichotomy is depicted in FIG. 2, where it can be seen that the original frequency characteristic of filter A moves, as a function of milling, to a new frequency characteristic A′ as a relatively linear function. Filter B, however, moves initially at a slower rate of change because material effecting its performance is only being removed from one side. As a result, while the initial difference in frequency between the two filters is originally depicted as Z, the final difference in frequency is depicted as Z′, which is less than the original difference in frequency between the two filters.

It can therefore be seen that coarse tuning such a device with double-sided lapping is made more difficult because the characteristics of the two filters change at different rates.

Figure 3:
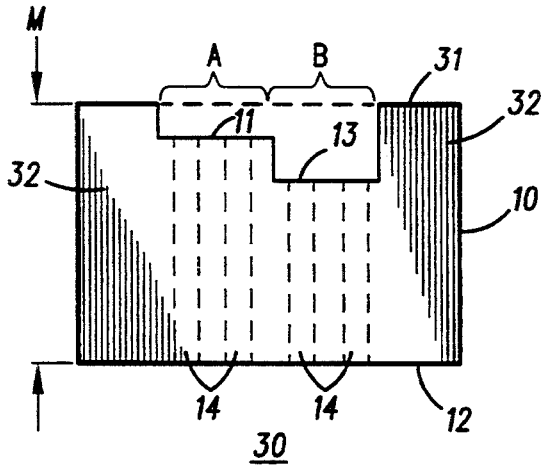
FIG. 3 comprises a side elevational view of a multi-filter ceramic block as configured in accordance with the invention.

Referring now to FIG. 3, a first embodiment of the present invention will be described. A ceramic block (10) is again provided, which block (10) includes a first filter A and a second filter B, wherein both filters have a plurality of resonator cavities (14) that extend between the opposing surface (12) and the filter A and B surfaces (11 and 13). In this embodiment, however, both of the filter A and B surfaces (11 and 13) comprise notches that have been formed in the side (31) that comprises the upper surface in this depiction. So configured, filters A and B are flanked by portions (32) of the ceramic block (10) that extend outwardly further than do the upper surfaces (11 and 13) of either filter A or B.

Figure 4:
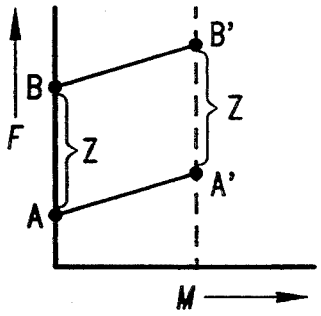
FIG. 4 comprises a graph depicting frequency characteristics of a multi-filter ceramic block as configured in accordance with this invention during a double-sided lap procedure.

Because of this configuration, when double-sided lapping is utilized to mill the ceramic block (10) both filters A and B change their frequency response at the same rate. This occurs because milling on the common opposing surface (12) affects both filters in a similar manner. Milling on the upper portion (32) affects neither filter A or B because both filters A and B have individual frequency responses that are substantially independent of the upper portion (32). As a result, and referring to FIG. 4, it can be seen that the original difference in frequency between the two filters (depicted here as Z) remains constant throughout the milling process. Of course, if the milling process were to continue such that milling began to occur on the filter A surface (11), then a differing rate of response alteration would of course result. By providing an appropriate amount of flanking material (32), however, this potential situation can be readily and easily avoided and an appropriate multifilter device (30) provided.

Figure 5:
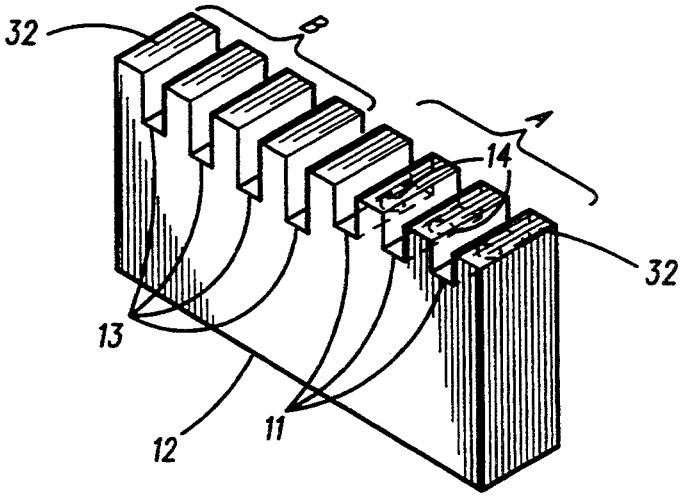
FIG. 5 comprises a prospective view of an alternative embodiment of a multi-filter ceramic block in accordance with the invention.

Referring now to FIG. 5, a second embodiment can be seen to include a first filter A having a plurality of notches (11) and a second filter B having a second plurality of notches (13). In this embodiment, block extension material (32) flanks each of the cavities (14). Depending upon the dimensions involved, such an embodiment may provide a sturdier construction.

Those skilled in the art will recognize that various alterations to the embodiments described could be made. For example, the notches that make up a particular filter need not all be of the same depth. Instead, they could be of different depths.

Figure 6:
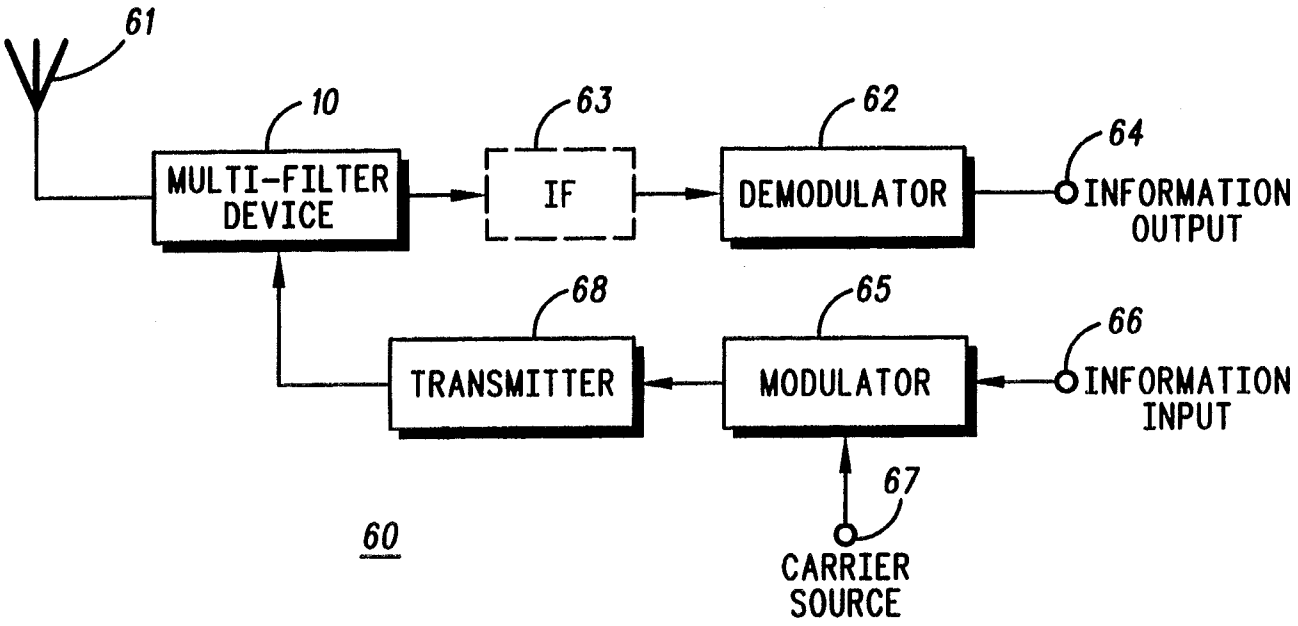
FIG. 6 comprises a block diagram of a radio that makes use of a multi-filter device in accordance with the present invention.

Referring now to FIG. 6, a radio that makes use of the multi-filter device (30) described above can be seen as generally depicted by reference numeral 60. This radio (60) includes an antenna (61) that couples to the multi-filter device (30) in accordance with well understood prior art technique. Whichever of the filters in the multi-filter device that comprises a receive filter in this particular application couples to a demodulator (62). (If desired, and depending upon the particular radio configuration used, the filter output may first pass through an intermediate frequency stage (63) as well understood in the art.) The output (64) of the demodulator (62) of course comprises the information output as well understood in the art. The radio (60) also includes a modulator (65) that receives information from an information input (66) (such as voice or data to be transmitted) and modulates this information on to a carrier as obtained from a carrier source (67), all as well understood in the art. The output of the modulator (65) then couples to a transmitter (68), which transmitter (68) couples to whichever of the filters in the multi-filter device (30) is serving as a transmit filter.

The above elements of a radio are well understood, and hence no further description need be provided. So configured, it should be appreciated that the multi-filter device (30) as disclosed herein can be provided for use in such a radio, which filter (30) can either be more appropriately tuned than prior art devices, or that can be equally as well tuned with less difficulty during the manufacturing process. So configured, the applicant has provided a multi-filter device that is amenable to existing double-sided lapping processes while simultaneously ensuring a more accurately controlled coarse tuning process.

What is claimed is:

1. A multi-filter device, comprising:

A) a single ceramic block having a first surface and a second surface, wherein the first surface opposes the second surface;

B) a first filter formed in the single ceramic block, wherein the first filter includes at least a first notch formed in the first surface;

C) a second filter formed in the single ceramic block, wherein the second filter includes at least a second notch formed in the first surface, which second notch extends into the ceramic block a greater distance than does the first notch;

D) at least two flanking portions formed of the single ceramic block, wherein each of the at least two flanking portions include at least portions of the first surface; wherein the first and second filters have individual frequency responses that are substantially independent of the at least two flanking portions and the first surface.

2. The multi-filter device of claim 1, wherein the first filter includes at least one first filter hole formed through the ceramic block.

3. The multi-filter device of claim 2, wherein the at least one first filter hole extends between the second surface and the first notch.

4. The multi-filter device of claim 1, wherein the second filter includes at least one second filter hole formed through the ceramic block.

5. The multi-filter device of claim 4, wherein the at least one second filter hole extends between the second surface and the second notch.

6. The multi-filter device of claim 1, wherein:

A) the first filter includes at least one first filter hole formed through the ceramic block;

B) the second filter includes at least one second filter hole formed through the ceramic block.

7. The multi-filter device of claim 6, wherein:

A) the at least one first filter hole extends between the second surface and the first notch;

B) the at least one second filter hole extends between the second surface and the second notch.

8. A multi-filter device, comprising:

a) single ceramic block having a first surface on a second surface, wherein the first surface opposes the second surface;

b) a first filter formed in the single ceramic block, wherein the first filter includes a plurality of first notches formed in the first surface;

c) a second filter formed in the single ceramic block, wherein the second filter includes a plurality of second notches formed in the first surface, which second notches extend into the ceramic block a greater distance than do the plurality of first notches;

d) at least two flanking portions formed of the single ceramic block, wherein each of the at least two flanking portions include at least portions of the first surface;

wherein the first and second filters have individual frequency responses that are substantially independent of the at least two flanking portions and the first surface.

9. The multi-filter device of claim 8, wherein the first filter includes at least one first filter hole formed through the ceramic block for each of the first notches.

10. The multi-filter device of claim 9, wherein the at least one first filter hole extends between the second surface and the first notch.

11. The multi-filter device of claim 8, wherein the second filter includes at least one second filter hole formed through the ceramic block for each of the second notches.

12. The multi-filter device of claim 11, wherein the at least one second filter hole extends between the second surface and the second notch.

13. The multi-filter device of claim 8, wherein:

A) the first filter includes at least one first filter hole formed through the ceramic block for each of the first notches;

B) the second filter includes at least one second filter hole formed through the ceramic block.

14. The multi-filter device of claim 13, wherein:

A) the at least one first filter hole extends between the second surface and the first notch;

B) the at least one second filter hole extends between the second surface and the second notch.

15. A two-way radio, comprising:

a) an antenna;

b) a multi-filter device, comprising:

a single ceramic block having a first surface and a second surface, wherein the first surface opposes the second surface;

a transmit filter formed in the single ceramic block and that is operably coupled to the antenna, wherein the transmit filter includes at least a first notch formed on the first surface;

a receive filter formed in the single ceramic block and that is operably connected to the antenna, wherein the receive filter includes at least a second notch formed in the first surface, which second notch extends into the ceramic block a different distance than does the first notch;

at least two flanking portions formed of the single ceramic block, wherein each of the at least two flanking portions include at least portions of the first surface;

wherein the transmit filter and receive filter have individual frequency responses that are substantially independent of the at least two flanking portions and the first surface c) a demodulator that is operably coupled to the receive filter;

d) a transmitter that is operably coupled to the transmit filter; and e) a modulator that is operably coupled to the transmitter.

16. A multi-level filter, comprising:

A) a single ceramic block having a first side and an opposing second side, wherein, the first side has:

i) a first surface that is located a first distance from the second side;

ii) a first plurality of notches formed in the first side that are located at a second distance from the second side that is less than the first distance;

iii) a second plurality of notches formed in the first side that are located at a third distance from the second side that is less than the first distance;

B) a first filter comprising at least one first filter hole formed between the second side and at least one of the first plurality of notches;

C) a second filter comprising at least one second filter hole formed between the second side and at least one of the second plurality of notches.

17. The multi-filter device of claim 16, wherein the third distance is less than the second distance.

18. A method of forming a multi-filter device comprised of a ceramic block, comprising the steps of:

A) providing a ceramic block having a filter characteristic and having a first surface and a second surface, wherein:

the first surface opposes the second surface;

the first surface has at least a first notch and a second notch formed therein, which second notch extends into the ceramic block a greater distance towards the second surface than does the first notch; and the ceramic block has at least a first cavity formed between the second surface and the first notch, and at least a second cavity formed between the second surface and the second notch;

B) determining a final desired filter characteristic for the ceramic block;

C) simultaneously milling both the first and second surfaces of the obtain the final desired filter characteristic for the ceramic block, wherein milling of the first surface has substantially no affect on obtaining the final desired filter characteristic, and milling of the second surface does affect obtainment of the final desired filter characteristic of the ceramic block.

* * * * *